US010096926B2

(12) United States Patent
Mackie

(10) Patent No.: US 10,096,926 B2
(45) Date of Patent: Oct. 9, 2018

(54) LOW COST-LOW PROFILE LEAD SET CONNECTOR

(75) Inventor: Francis Kusti Mackie, Hampstead, NH (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1282 days.

(21) Appl. No.: 13/377,834

(22) PCT Filed: Jun. 14, 2010

(86) PCT No.: PCT/IB2010/052654

§ 371 (c)(1),
(2), (4) Date: Dec. 13, 2011

(87) PCT Pub. No.: WO2011/001314

PCT Pub. Date: Jan. 6, 2011

(65) Prior Publication Data

US 2012/0089002 A1 Apr. 12, 2012

Related U.S. Application Data

(60) Provisional application No. 61/222,135, filed on Jul. 1, 2009.

(51) Int. Cl.
*H01R 13/24* (2006.01)
*H01R 12/69* (2011.01)

(52) U.S. Cl.
CPC ..... *H01R 13/2471* (2013.01); *H01R 12/69* (2013.01); *H01R 2201/12* (2013.01); *Y10T 29/49117* (2015.01)

(58) Field of Classification Search
CPC ..... H01R 13/2471; H01R 12/69; H01R 2201/12; H01R 13/2442; H01R 13/22;
(Continued)

(56) References Cited

U.S. PATENT DOCUMENTS 4,666,226 A 5/1987 Legrand et al.
4,670,522 A * 6/1987 Chen ..... C08L 77/00 525/408

(Continued)

FOREIGN PATENT DOCUMENTS

DE 4408652 A1 9/1995
DE 29923807 U1 5/2001

(Continued)

*Primary Examiner* — Tiffany Weston
*Assistant Examiner* — Tho Tran

(57) ABSTRACT

A patient worn medical monitoring device (10) includes a multi-channel electrical connector (18) for connecting a lead set (22) to a monitoring unit (16) is able to wirelessly transmit a patient's physiological data over a telemetric link to a receiver unit for remote monitoring purposes. The multi-channel electrical connector includes first and second connector elements (40,42) disposed on either one of the monitoring unit or lead set. The first connector element includes a plurality of rigid pins (44) disposed between a plurality of ribs (50). The second connector element includes a compressible substrate carrying flexible electrically conductive pads (46) that flex independently of one another. The connector elements to are configured to such that the pins of the first connector element electrically engage the flexible electrically conductive pads of the second connector element.

20 Claims, 9 Drawing Sheets

(58) Field of Classification Search
CPC .. H01R 13/245; H01R 13/03; Y10T 29/49117
See application file for complete search history.

(56) References Cited

U.S. PATENT DOCUMENTS

| | | | | |
|---|---|---|---|---|
| 5,137,466 | A * | 8/1992 | Endo et al. | 439/357 |
| 5,232,383 | A | 8/1993 | Barnick | |
| 5,341,812 | A * | 8/1994 | Allaire et al. | 600/508 |
| 5,380,210 | A * | 1/1995 | Grabbe | H01R 13/2435 439/66 |
| 5,433,632 | A * | 7/1995 | Cherney | H01R 12/777 439/495 |
| 5,679,022 | A | 10/1997 | Cappa et al. | |
| 6,116,940 | A * | 9/2000 | Bertens et al. | 439/357 |
| 6,211,572 | B1 * | 4/2001 | Fjelstad | H01L 23/3114 257/759 |
| 6,533,588 | B1 | 3/2003 | Woith et al. | |
| 6,870,484 | B1 * | 3/2005 | Brinsfield et al. | 340/8.1 |
| 7,025,601 | B2 * | 4/2006 | Dittmann | H01R 13/2435 439/66 |
| 7,144,268 | B2 | 12/2006 | Koenig et al. | |
| 8,373,557 | B2 | 2/2013 | Smith et al. | |
| 2003/0148651 | A1 * | 8/2003 | Shuman et al. | 439/358 |
| 2005/0196994 | A1 * | 9/2005 | Bilcauu | G06K 7/0021 439/326 |
| 2005/0255731 | A1 | 11/2005 | Biagetti et al. | |
| 2006/0036134 | A1 | 2/2006 | Tarassenko et al. | |
| 2009/0017679 | A1 * | 1/2009 | Ma | H01R 12/592 439/607.01 |
| 2010/0094098 | A1 | 4/2010 | Smith et al. | |

FOREIGN PATENT DOCUMENTS

| | | | |
|---|---|---|---|
| DE | 102008015388 | A1 | 6/2009 |
| EP | 0182700 | A1 | 5/1986 |
| EP | 0767977 | B1 | 9/2000 |
| JP | 4046394 | B2 | 7/1992 |
| JP | 11031544 | A | 2/1999 |
| JP | 2000067972 | A | 3/2000 |

* cited by examiner

Enlargement A

LOW COST-LOW PROFILE LEAD SET CONNECTOR

CROSS REFERENCE TO RELATED APPLICATIONS

This application claims the benefit of U.S. provisional application Ser. No. 61/222,135 filed Jul. 1, 2009, which is incorporated herein by reference.

The present application relates to remote patient monitoring. It finds particular application to lead set connectors, for example ECG lead sets for use patient worn telemetry devices.

Patient worn devices (PWDs) are used to monitor a patient's vital signs. The devices are provided with an internal battery power supply in a wearable housing generally supported by a pouch, sling, belt clip, or the like allowing the patient to ambulate normally while continuously monitoring their condition. Some designs simply record the patient's physiological data for later analysis, and others transmit the physiological data by a telemetric link via radio-link. The physiological signal is transmitted wirelessly a central monitoring and display station. The obvious advantage is that immediate indication is available of a deterioration in the patient's condition.

A wide variety of physiological data can be measured with PWDs. For example, a PWD used to monitor a patient's ECG signal typically uses three to five electrodes attached to the chest. The electrodes are connected by lead wires to the device's electronics in a wearable housing. Other physiological data is often monitored concurrently, such as $SpO_2$, pulse rate, and the like. A detachable arrangement between the lead wires and the housing is achieved by a lead-set connector that electrically connects to a front-end on the housing. Traditional lead-set connectors incorporate bulky cantilevered electrical connector elements mounted to a printed circuit board. The cantilevered elements are spring biased to make firm contact with contacts of a mating connector.

Medical equipment is typically sanitized or disinfected after each use. The cantilevered connector elements provide difficult to reach, protected areas for germs, viruses, and the like to lodge. Electronic equipment which can be damaged by high temperatures sterilization are typically cleaned with liquid disinfectants. Air can become trapped under the cantilevered elements preventing liquid disinfectants from reaching the germs, etc. When liquid disinfectants do flow under the cantilevered elements, some may become trapped there. Because the liquid disinfectants are often a strong chemical, e.g. acid, for attacking the germs, their residue can cause corrosion. Also, as the disinfectant residue evaporates, it may leave a residue. This leads to a shortened connector life and the potential for some for the leads to be left unconnected or poorly connected.

Current lead-set connectors are expensive to manufacture, difficult to clean, and have design constraints when attempting to deal with mandated safety requirements.

The present application provides a new and improved multi-channel lead set connector which overcomes the above-referenced problems and others.

In accordance with one aspect, a multi-channel electrical connector for use in medical devices is presented. The connector includes a first connector element having a plurality of pins engaging flexible conductive pads on a compressible substrate of a second connector element.

In accordance with another aspect, a method of making a connector element is presented. A flexible circuit is manufactured with a plurality of flexible electrically conductive pads on a flexible layer. The a flexible circuit is assembled on to a resilient support pad. A housing, with a rigid face and two side members, creates an interference fit between the flexible circuit on the support pad and itself.

One advantage resides in reduced cost.

Another advantage resides in ease of disinfection.

Another advantage resides in efficient utilization of space.

Still further advantages of the present invention will be appreciated to those of ordinary skill in the art upon reading and understand the following detailed description.

The invention may take form in various components and arrangements of components, and in various steps and arrangements of steps. The drawings are only for purposes of illustrating the preferred embodiments and are not to be construed as limiting the invention.

Figure 1:
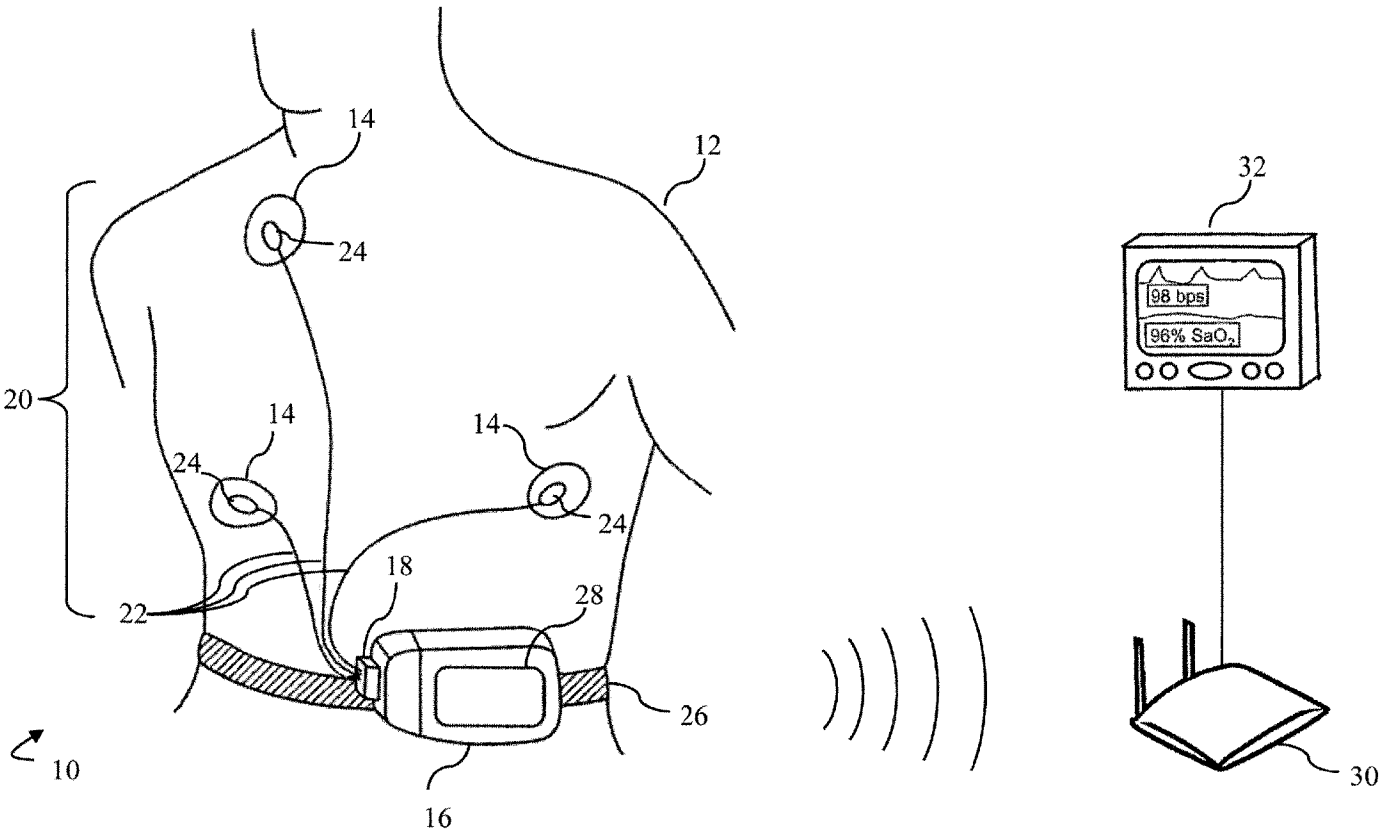
FIG. 1 is a diagrammatic illustration of a patient worn medical monitoring device.

With reference to FIG. 1, a patient worn medical monitoring device 10 positioned on a patient 12 is illustrated. The patient worn medical monitoring device includes a plurality of sensors 14 attached, e.g. adhesively, to the patient for detecting physiological data, for example ECG, $SpO_2$, pulse rate, and the like. The sensors translate the physiological data into electrical signals which are provided to a monitoring unit 16 through a multi-channel electrical connector 18, which will be described in more detail below. A lead set 20 is connected to the multi-channel electrical connector and the sensors. Specifically, the lead set includes a number of lead wires 22, e.g. 10-20 or more, which are each electrically connected to a channel of the multi-channel electrical connector, and terminate in the case of ECG systems into a clip 24, which are electrically connected to the sensors 14, particularly disposable electrodes. The sensors can be permanently fixed the leads to reduce cost; however, removably attached sensors allow for easily replaceable faulty sensors and the use of various sensors used in tandem. The monitoring unit is supported by a belt 26 as example; other means of supporting the monitoring unit include a pouch, sling, strap, or the like. The monitoring unit includes an antenna 28 to transmit physiological data over a telemetric link to a receiver unit 30 and display unit 32 for the patient to be remotely monitored.

Figure 2B:
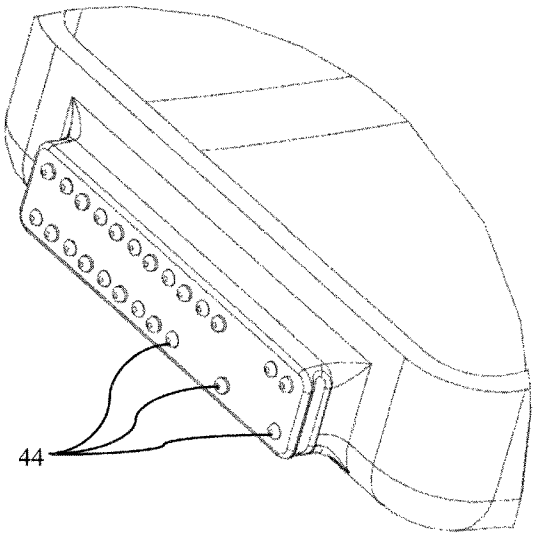
FIG. 2 is a perspective view of one embodiment of first and second connector elements of a multi-channel electrical connector.
Figure 2A:
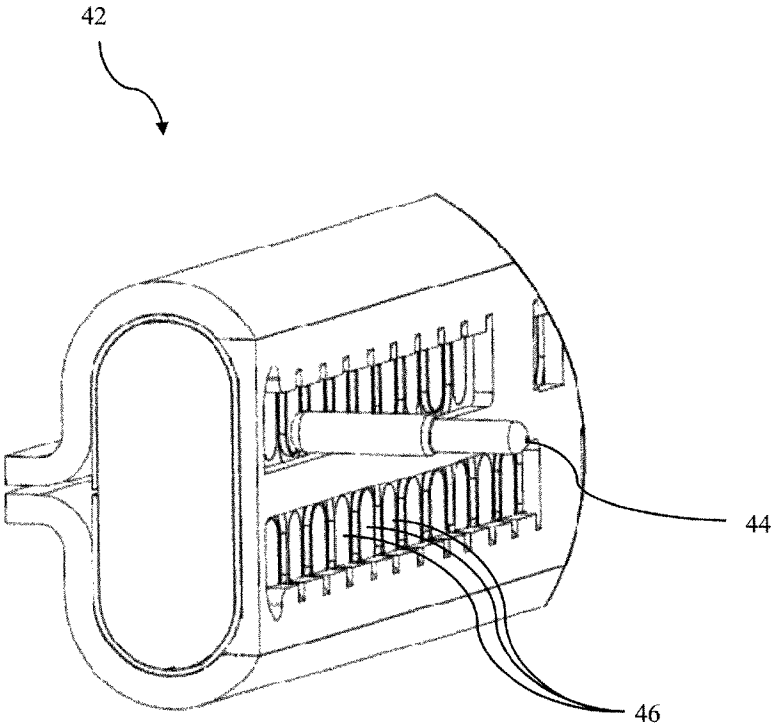

FIGS. 2A and 2B are perspective views in partial section of the multi-channel electrical connector 18. The multi-channel electrical connector includes a first connector element 40, FIG. 2B, as part of the monitoring unit 16 and a second connector element 42, FIG. 2A, as part of the lead set 18. The first connector element includes a plurality of pins 44 that press against flexible electrically conductive pads 46 of the second connector element to create an electrical connection between the sensors 14 and the monitoring unit.

Figure 3B:
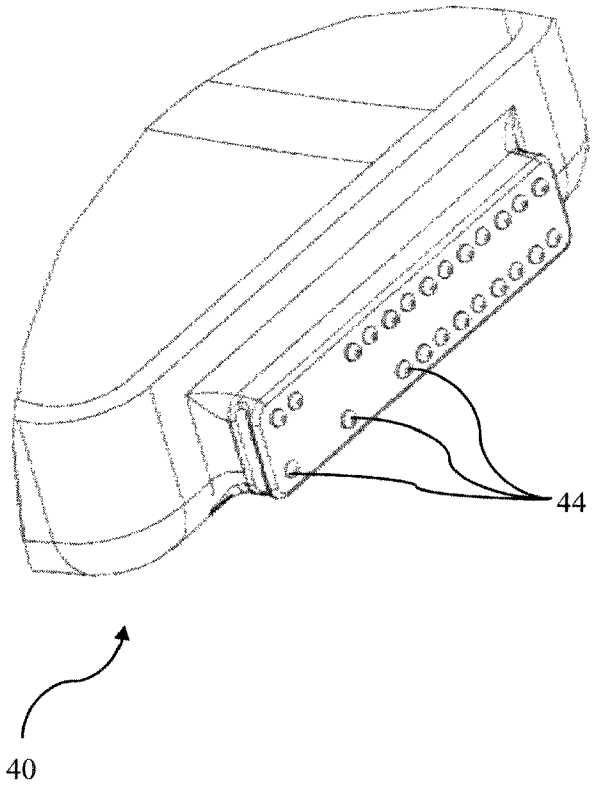
FIGS. 3A and 3B are perspective views of an embodiment of a first connector element and monitoring device.
Figure 3A:
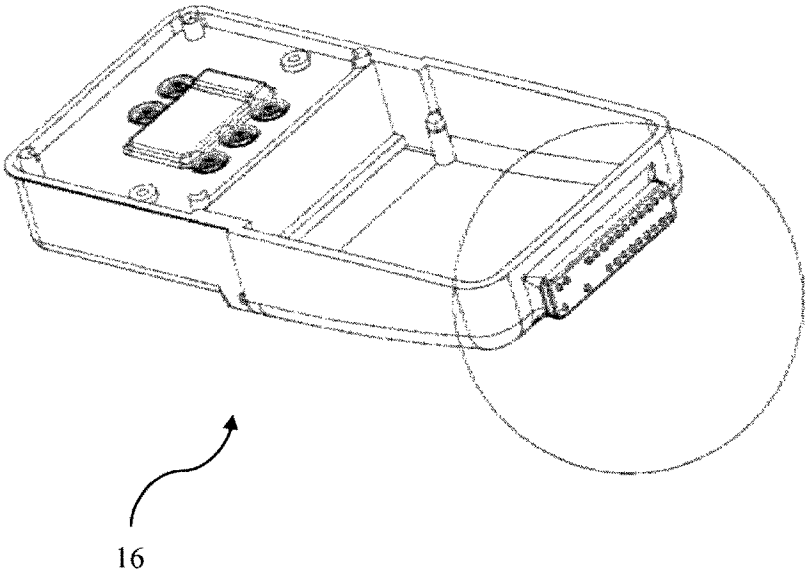

With reference to FIGS. 3A and 3B, one embodiment of the first connector element 40 is illustrated. As shown in the zoomed perspective view of FIG. 3B, the first connector element is integrated into the monitoring unit 16. It should be appreciated that the first connector element may also be manufactured as a separate article and affixed to the monitoring with fasteners, glue, or the like. The pins 44 are rigidly mounted into the first connector element or to a printed circuit board housed within the monitoring unit itself. The rigidly mounted pins, opposed to traditional cantilevered pins, not only reduce the manufacturing and repair costs of the monitoring unit, but also improve the reliability, disinfectability, and lifetime of the first connector element. The monitoring unit and first connector element can be hermetically sealed to keep fluids, such as corrosive disinfectants, from damaging the onboard electronics or the pins themselves.

Figure 4B:
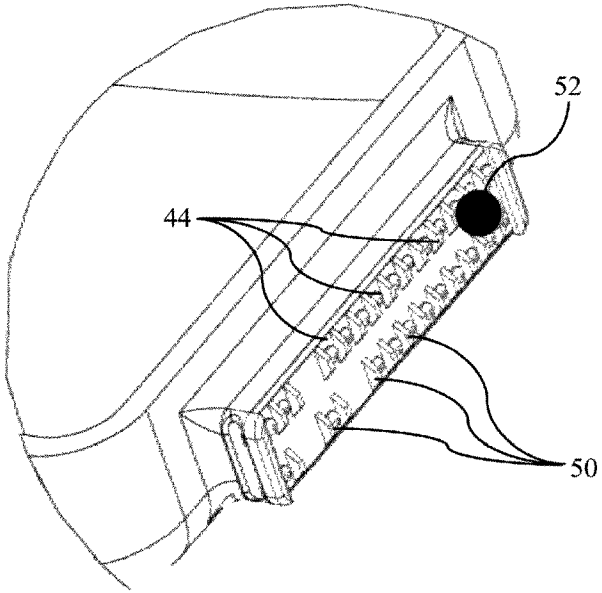
FIGS. 4A and 4B are perspective views of another embodiment of a first connector element and monitoring device.
Figure 4A:
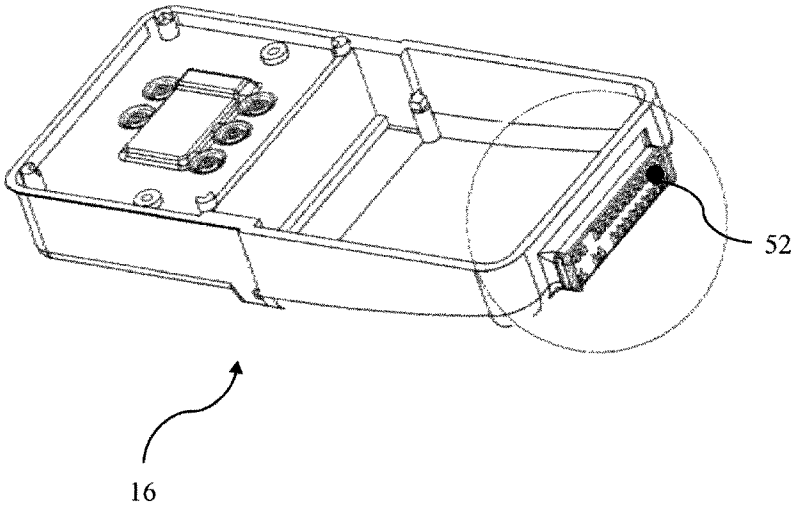

With reference to FIGS. 4A and 4B, another embodiment of the first connector element is illustrated. As shown in the zoomed perspective view of FIG. 4B, ribs 50 are disposed between the individual pins 44 of the first connector element. They protect the unit from accidental short circuits between pins by, for example, a finger. The ribs 50 are dimensioned and spaced to meet the safety standards such as those mandated by the International Electrotechnical Commission (IEC) in the Standard Finger Safety Test 60601-1. Test probe 52 simulates a finger tip that, as seen in FIG. 4B, is too large to fit between the ribs.

Figure 5B:
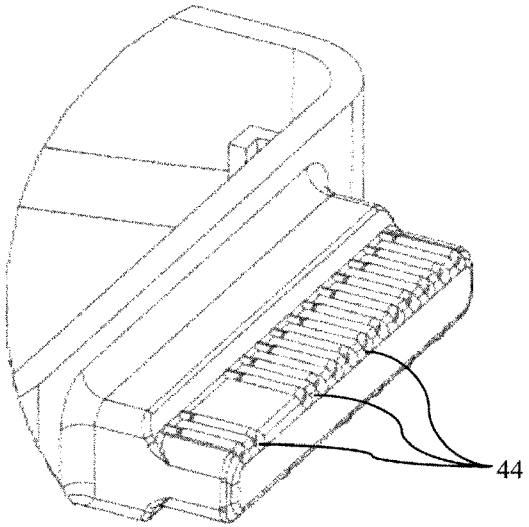
FIGS. 5A and 5B are perspective views of another embodiment of a first connector element and monitoring device.
Figure 5A:
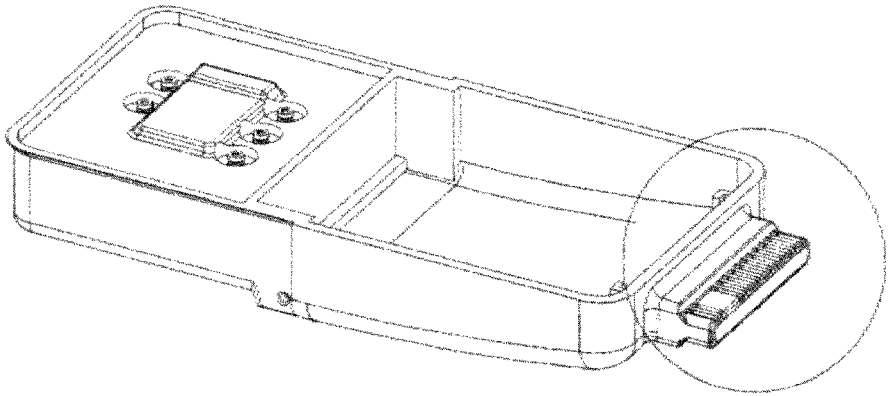

As will be apparent to those skilled in the art, a number of variations to the mating arrangement between the pins 44 and the flexible electrically conductive pads 46 are possible. As shown in FIGS. 2-4, the pins 44 are arranged perpendicularly to the flexible electrically conductive pads 46. With reference to FIGS. 5A and 5B, the pins and the flexible electrically conductive pads can be arranged parallel to one another. The first connector element has a longer profile in this arrangement. The longer profile has difficulties passing the Standard Finger Safety Test 60601-1 as depicted by safety probe 52.

Figure 6B:
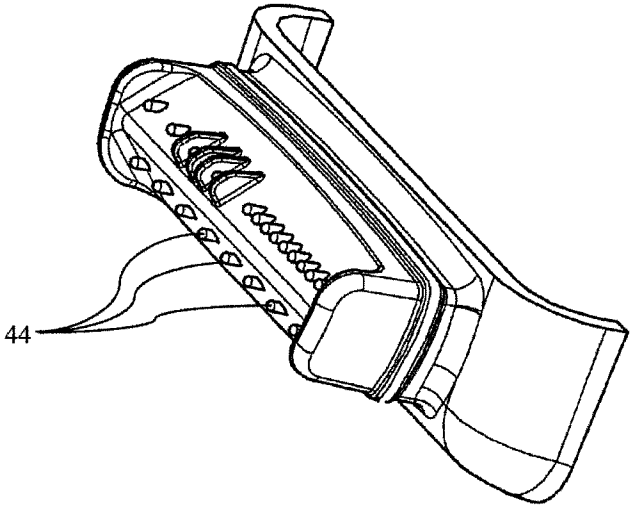
FIGS. 6A and 6B are perspective views of another embodiment of first and second connector element.
Figure 6A:
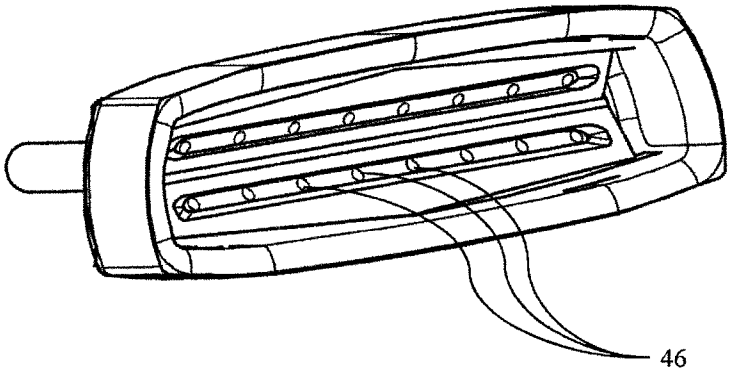

With reference to FIGS. 6A and 6B, the pins 44 and the flexible electrically conductive pads 46 can be arranged at an angle to one another. This can allow for a shorter profile first connector which may be appropriate in situations where there will be a higher probability of accidental disconnections so damage to the multi-channel electrical connector can be avoided. The sliding movement between the pins 44 and pads 46 remove any surface corrosion or deposits resulting from being disinfected.

Figure 7:
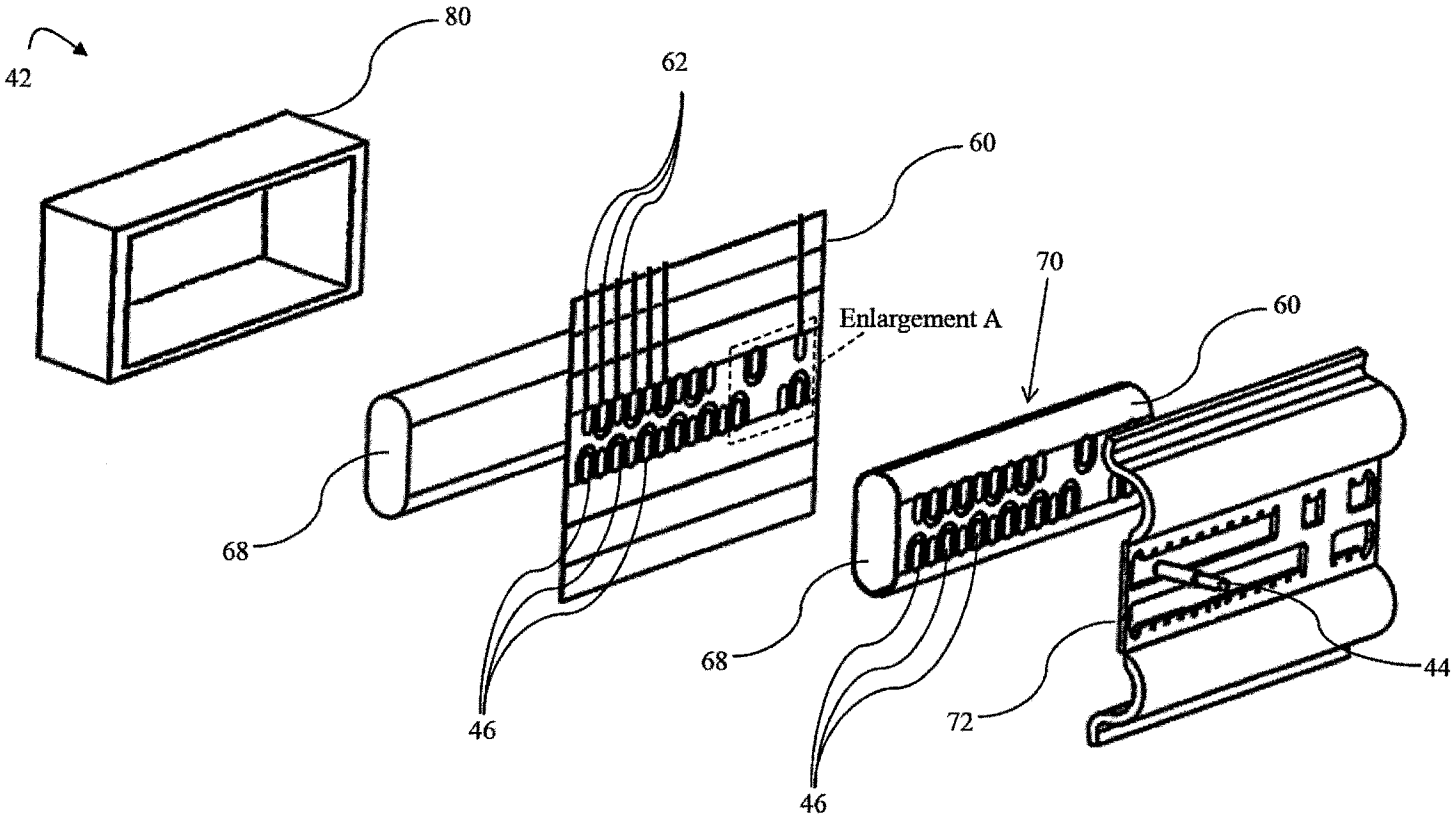
FIG. 7 is an exploded view of a first connector element.

With reference to FIG. 7, the second connector element 42 will be described in greater detail in relation to the exploded illustration. The second connector element includes a flexible circuit 60 which is manufactured using traditional flexible circuit fabrication. Generally, gold or copper conductors are chemically etched or electro-plated to form a metallic layer bonded to a flexible substrate such as a polyamide film like Kapton® or polyaryletheretherketone (PEEK) films. Flexible circuits can also be silk screened onto polyester or other substrates.

Figure 8:
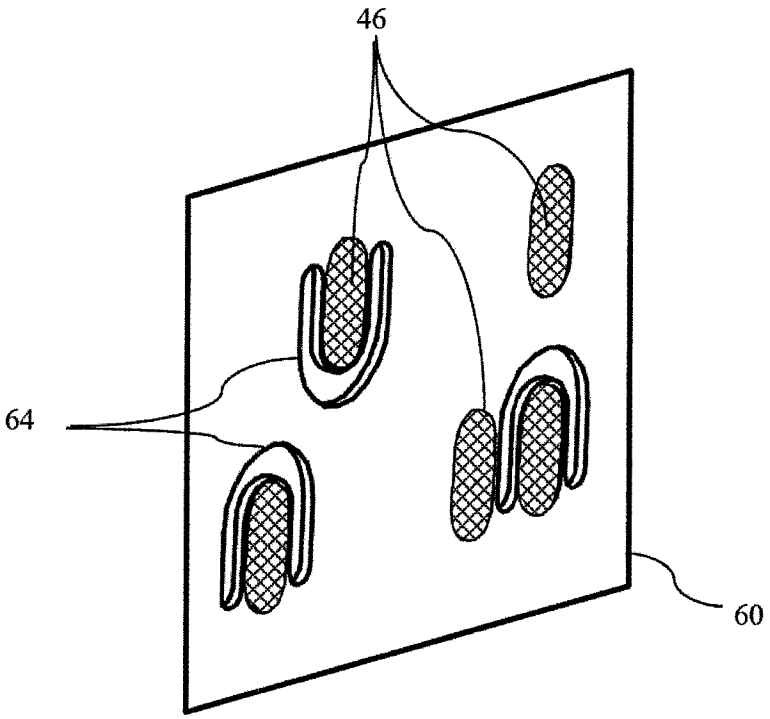
FIG. 8 is a zoomed view of a flexible circuit.

Disposed on the surface of the flexible circuit 60 are the flexible electrically conductive pads 46 and electrically conductive traces 62. The electrical conductive traces 62 operatively connect the flexible electrically conductive pads 46 to the lead wires 22 (shown in FIG. 1). The lead wires are soldered, crimped, or the like to the ends of the traces 62. In one embodiment, u-shaped cuts 64 (labeled in FIG. 8) partially along the perimeter of each flexible electrically conductive pad allow the pads to flex independent of the flexible substrate 60. FIG. 8, which shows a zoomed view ("Enlargement A") of flexible electrically conductive pads 46, illustrates the cuts 64 in the flexible circuit 60 which allow the flexible electrically conductive pad 46 to deflect when the first and second connector elements are joined. It should also be appreciated that a flexible circuit with no cuts is also contemplated if the flexibility of the substrate is acceptable, thus reducing cost.

With returning reference to FIG. 7, the flexible circuit 60 is supported by a compressible support pad 68 made of a soft, resilient material such as silicone, thermoplastic elastomer (TPE), rubber, closed cell foam, or the like. When the two connector elements are connected, the compressible support pad 68 provides a constant force on the back of the flexible electrically conductive pads 46 in the direction of the pins 44 to create a constant electrical contact. A contact adhesive may be used to join or affix the flexible circuit 60 to the compressible support pad 68 to form a compressible substrate 70. The adhesive will also prevent contaminants from lodging under the flexible electrically conductive pads.

Figure 9B:
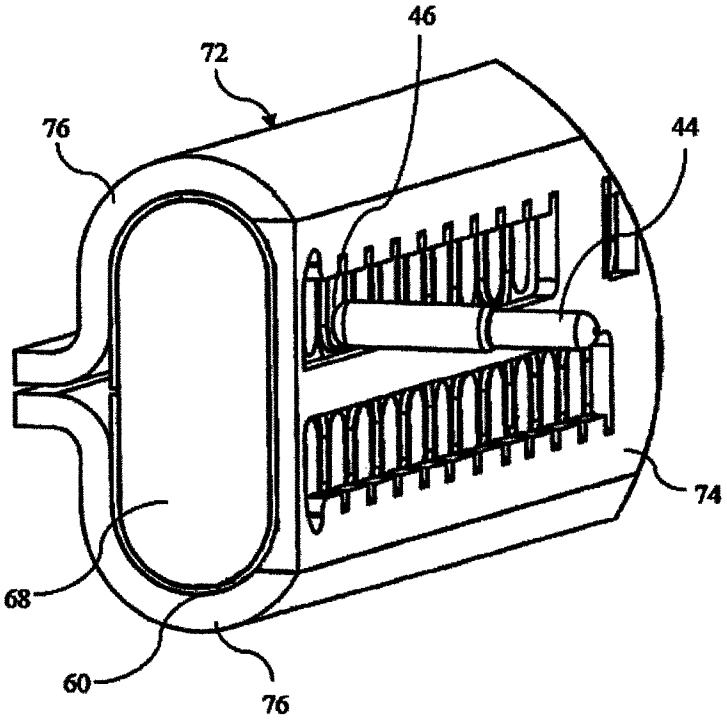
FIG. 9B is a perspective view in partial of the first connector element.
Figure 9A:
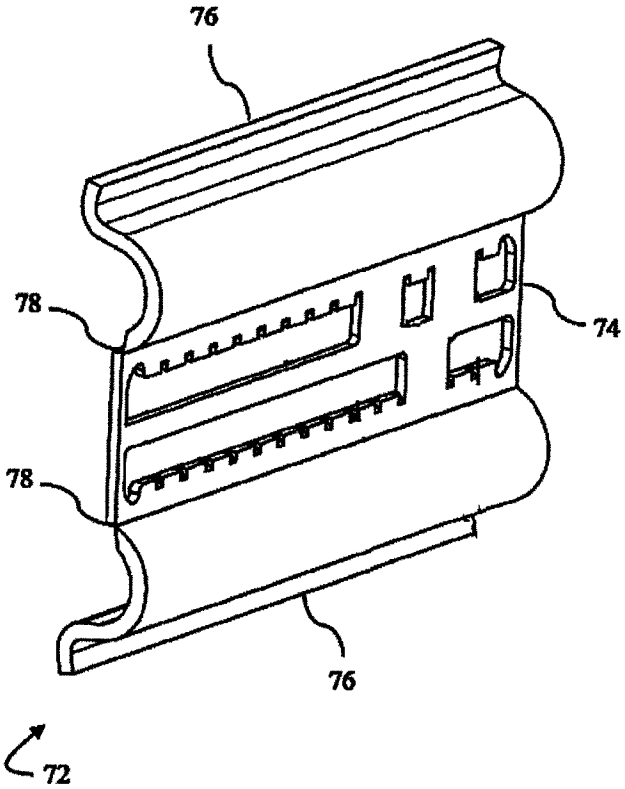
FIG. 9A is a perspective view of a housing.

The compressible substrate 70 is surrounded by a housing 72, which is dimensioned to create an interference fit designed to provide a constant compression on the compressible substrate. The housing will be described in reference to FIGS. 9A and 9B which illustrate zoomed views of one embodiment of the housing. The housing includes a rigid face 74 joined between two side members 76 by a pair of living hinges 78. When hinged, the ends of the side members lock together, e.g. by a snap mechanism or the like, to form the interference fit. Side members also act to fixate the lead wires 22 attached to the flexible circuit into a secured position. The rigid face defines a plurality of apertures around each flexible electrically conducting pads 46 and to allow the pins 44, and if necessary the ribs 50, to mate with pads. The apertures are designed to meet safety standards as mandated by the IEC in the Standard Finger Safety Test 60601-1. The housing can be manufactured using traditional injection molding processes using rigid, chemically resistant materials; however, other manufacturing processes are also contemplated. In another embodiment, a two part housing with snap fits at both ends of each part which come together to form the interference fit and various geometries are also contemplated.

With returning reference to FIG. 7, once the compressible substrate 70 is assembled into the housing 72, an over-molding 80 is molded over the entire assembly. The over-molding is a soft, chemically resistant outer-shell that protects the second connector element 42. When the first and second connector elements are joined, the over-molding connects to the monitoring unit 16, e.g. by a friction fit or the like, to create a fluid resistant seal protecting both the first and second connector elements and preventing the connector elements from disconnecting.

In another embodiment, a method is disclosed of making a connector. The connector includes a first and second connector element. Making one of the connector elements comprises: manufacturing a flexible circuit with a plurality of flexible electrically conductive pads disposed on a non-conducting flexible layer; forming a support pad from a resilient material; assembling the flexible circuit on an outer surface of the support pad; forming a housing with a rigid face between two side members; and creating an interference fit between the housing, the flexible circuit, and the support pad.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

Having thus described the preferred embodiments, the invention is now claimed to be:

1. A multi-channel electrical connector for use with medical devices, the connector comprising:

a first connector element having a plurality of pins; and a second connector element comprising (i) a flexible circuit including a non-conducting flexible layer, electrically conductive pads disposed on a front surface of the non-conducting flexible layer, and electrically conductive traces disposed on the non-conducting flexible layer and connected with the electrically conductive pads, and (ii) a compressible support pad arranged on a back surface of the non-conducting flexible layer opposite from the front surface on which the electrically conductive pads are disposed;

wherein the front surface of the non-conducting flexible layer includes a first front side portion and a second front side portion, the first and second front side portions being angled toward each other to define a cavity, the first and second front side portions being non-parallel to each other;

wherein the electrically conductive pads include a first set of electrically conductive pads disposed on the first front side portion and a second set of electrically conductive pads disposed on the second front side portion;

wherein the first and second connector elements are configured to mate with the pins of the first connector element engaging the electrically conductive pads of the second connector element with the compressible support pad of the second connector element providing supporting force on the backs of the electrically conductive pads of the second connector element;

wherein the pins of the first connector element and the electrically conductive pads of the second connector element are arranged at an angle to one another such that the pins of the first connector element mate at an angle to the flexible electrically conducting pads of the second connector element.

2. The multi-channel electrical connector according to claim 1, wherein each electrically conductive pad flexes independently of one another.

3. The multi-channel electrical connector according to claim 1, wherein the second connector element further comprises:

a housing surrounding a compressible substrate comprising the flexible circuit and the compressible support pad, the housing configured to exert a constant compressional force on the compressible substrate; and an over-molding configured to create a fluid resistant seal.

4. The multi-channel electrical connector according to claim 3, wherein the housing defines apertures around each flexible electrically conducting pads to allow the pins and flexible electrically conducting pads to mate.

5. The multi-channel electrical connector according to claim 1, the first connector element further including:

a plurality of ribs disposed between the pins.

6. The multi-channel connector according to claim 1, wherein:

the non-conducting flexible layer is cut along a partial perimeter of each of the flexible electrically conductive pads.

7. A patient worn medical monitoring device, including:

a lead set;

a monitoring unit which stores, processes, or transmit data; and a multi-channel electrical connector according to claim 1, the lead set being connected with one of the pins and the flexible electrically conductive pads and the monitoring unit being connected with the other.

8. The patient worn medical monitoring device according to claim 7, further including:

a plurality of sensors which are configured to attach to a patient to detect physiological data, the sensors being connected with leads of the lead set.

9. The patient worn medical monitoring device according to claim 7, the monitoring unit further including:

an antenna for transmitting physiological data wirelessly.

10. A wireless patient monitoring system, including:

a patient worn medical monitoring device according to claim 7 configured to wirelessly transmit physiological data; and a receiver configured to receive the physiological data from the patient worn device; and a display unit configured to display an image representation of the physiological data.

11. An electrical connector adapted to mate with an associated multi-pin electrical connector, the electrical connector comprising:

a flexible circuit including:

a flexible layer with a front surface that includes a first front side portion and a second front side portion forming a cavity, the first and second front side portions being non-parallel and angled toward each other;

electrically conductive pads disposed on the front surface of the flexible layer, the electrically conductive pads including a first set of electrically conductive pads disposed on the first front side portion and a second set of electrically conductive pads disposed on the second front side portion; and electrically conductive traces disposed on the flexible layer and connected with the electrically conductive pads;

wherein the electrically conductive pads are arranged to engage pins of the associated multi-pin electrical connector at an angle to form sliding engagements between the electrically conductive pads and the pins when the associated multi-pin electrical connector mates with the electrical connector; and a compressible support pad arranged on a back surface of the flexible layer opposite from the front surface on which the electrically conductive pads are disposed to support the electrically conductive pads when the electrically conductive pads engage the pins of the mated associated multi-pin electrical connector.

12. The electrical connector of claim 11 wherein the flexible layer of the flexible circuit is cut partially along the perimeter of each electrically conductive pad to allow the electrically conductive pads to flex independent of the flexible layer.

13. The electrical connector of claim 11 wherein the flexible circuit is affixed to the compressible support pad by an adhesive.

14. The electrical connector of claim 11 further comprising:

a housing that houses the flexible circuit and the compressible support pad, the housing having apertures to allow the pins of the associated multi-pin electrical connector to engage the electrically conductive pads when the associated multi-pin electrical connector mates with the electrical connector.

15. The electrical connector of claim 11, wherein the flexible layer of the flexible circuit comprises a flexible polyamide film or polyaryletheretherketone (PEEK) film.

16. The electrical connector of claim 11, wherein the compressible support pad comprises silicone, thermoplastic elastomer (TPE), rubber, or closed cell foam.

17. An electrical connector adapted to mate with an associated multi-pin electrical connector, the electrical connector comprising:

a flexible circuit including:

a flexible layer with a front surface that includes a first front side portion and a second front side portion defining a cavity, the first and second front side portions being non-parallel and angled toward each other;

electrically conductive traces disposed on the flexible layer; and electrically conductive pads disposed on the flexible layer and connecting with the electrically conductive traces, wherein the electrically conductive pads include a first set of electrically conductive pads disposed on the first front side portion and a second set of electrically conductive pads disposed on the second front side portion, and wherein the electrically conductive pads are arranged to flex independently of one another and the electrically conductive pads have front sides arranged to engage pins of the associated multi-pin electrical connector at an angle to form sliding engagements between the electrically conductive pads and the pins when the associated multi-pin electrical connector mates with the electrical connector;

a compressible support pad arranged with the flexible layer interposed between the compressible support pad and the electrically conductive pads, the compressible support pad arranged to support back sides of the electrically conductive pads when the front sides of the electrically conductive pads engage the pins of the mated associated multi-pin electrical connector; and a housing that houses the flexible circuit and the compressible support pad and compresses the compressible support pad against the back sides of the electrically conductive pads, the housing having apertures to allow the pins of the associated multi-pin electrical connector to engage the front sides of the electrically conductive pads when the associated multi-pin electrical connector mates with the electrical connector.

18. The electrical connector of claim 17 wherein the flexible circuit is affixed to the compressible support pad by an adhesive.

19. The electrical connector of claim 17, wherein the flexible circuit comprises a flexible polyamide or polyaryletheretherketone (PEEK) film.

20. The electrical connector of claim 17, wherein the compressible support pad comprises silicone, thermoplastic elastomer (TPE), rubber, or closed cell foam.

* * * * *